United States Patent [19]

Nieman et al.

[11] 4,066,187

[45] Jan. 3, 1978

[54] VALVE UNIT FOR LIQUID DISPENSERS

[75] Inventors: Charles Wayne Nieman, Burlingame; Robert Peter Turkovich, Foster City; Robert Frank Castronovo, Belmont, all of Calif.

[73] Assignee: Trident Products Inc., South San Francisco, Calif.

[21] Appl. No.: 742,008

[22] Filed: Nov. 15, 1976

[51] Int. Cl.[2] ..... E03D 9/03

[52] U.S. Cl. ..... 222/57; 4/227; 4/228

[58] Field of Search ..... 222/57, 476, 561, 563, 222/564; 4/222, 223, 224, 227, 228, 231

[56] References Cited

U.S. PATENT DOCUMENTS

| | | | |
|---|---|---|---|
| 2,477,200 | 7/1949 | Penny | 222/564 X |
| 2,657,836 | 11/1953 | Heinz et al. | 222/564 X |
| 3,434,636 | 3/1969 | Kachman | 222/563 X |
| 3,841,524 | 10/1974 | Easter | 222/57 |
| 3,864,763 | 2/1975 | Spransy | 4/228 X |
| 3,908,209 | 9/1975 | Fillmore | 222/57 X |
| 3,926,348 | 12/1975 | Lutzker | 222/563 X |

*Primary Examiner*—Robert B. Reeves
*Assistant Examiner*—Fred A. Silverberg
*Attorney, Agent, or Firm*—Joseph L. Strabala

[57] ABSTRACT

A simple, economical valve unit for dispensing liquids and the like includes a cylindrical bell with an inwardly directed conical surface at one end and an outwardly directed radial flange at its opposite end with a central aperture in the conical surface and an open-ended buoyancy cylinder having a conical crown terminating in a projecting shaft received in the bell so said shaft extends through the aperture, and a cap seal attached to the distal end of the shaft whereby when the cylinder moves out of said bell, the cap seal will contact the conical surface in a sealing relationship, and when the cylinder moves into the bell, its conical surface will sealingly close the central aperture. The buoyancy cylinder is longer in axial length than said bell, so its projecting end can be engaged by a cap placed on a bottle in which the unit is installed to axially force its conical crown into the central aperture to prevent leakage of the liquid contents during shipment of the bottle in which the unit is installed.

2 Claims, 3 Drawing Figures

VALVE UNIT FOR LIQUID DISPENSERS

BACKGROUND OF THE INVENTION

Currently there are a large number of automatic dispensing devices for releasing a metered amount of chemical disinfectant and/or deodorizer into water closets each time flushing occurs. Detergents also may be dispensed with the disinfectant and/or deodorizer whereby the toilet bowl is partially cleaned as well as deodorized and/or disinfected each time flushing occurs.

The above dispensers are generally designed to use either solid chemicals or solutions of chemicals having the desired disinfectant, deodorizing and/or cleansing actions. Typical of the devices employed with solid chemicals are those shown in U.S. Pat. No. 3,121,236 issued to Yadro et al; U.S. Pat. No. 3,604,020 issued to Moisa and U.S. Pat. No. 3,769,604 issued to Castronovo.

When chemicals in solutions (liquids) are employed, these dispensers are constructed differently. U.S. Pat. Nos. 2,913,731 and 2,967,310 issued to O'Hare illustrate one type of dispenser used for liquids, which employs a reservoir concept. A measured amount of liquid is ladeled out of a reservoir in the dispenser shown in U.S. Pat. No. 3,241,718 issued to Kemper, which is another automatic liquid dispensing device for water closets.

Of the types of dispensers mentioned above, the current invention is related to those employed for dispensing liquids. It has, among its many objects, the provision of a simple, economical dispenser unit which provides a positive seal during shipment, as well as controlled metering of liquids when employed in water closets. Other objects will be obvious in the description of the invention which follows.

SUMMARY OF THE INVENTION

A liquid dispenser unit for bottles and the like according to this invention includes a cylindrical bell means having an inwardly conical surface with a central aperture closing one end and an outwardly directed radial flange at its mouth adapted to engage the circular opening of a bottle, a buoyancy cylinder means having a conical crown at one end terminating in a projecting shaft reciprocally received in the cylindrical bell so the shaft extends through the aperture, and a sealing cap means fixedly received on the distal end of the shaft whereby movement of the buoyancy cylinder means into the bell will ultimately cause the conical crown to engage the central aperture in a sealing relationship and movement of the buoyancy cylinder means out of said bell with ultimately cause the sealing cap to engage the top surface of the inwardly directed conical surface in a sealing relationship. The axial length of the buoyancy cylinder is greater than that of the bell so that a cap screwed onto a bottle in which the unit is attached can force the conical crown into the central aperture in a tight sealing relationship. The inwardly directed conical surface is designed to deflect, allowing a relatively large tolerance in the cap/bottle fit without loss of a tight positive seal for shipping.

BRIEF DESCRIPTION OF THE DRAWINGS

The invention will be better understood by reference to the appended drawings forming part of the application wherein.

DESCRIPTION OF A PREFERRED EMBODIMENT

Figure 1:
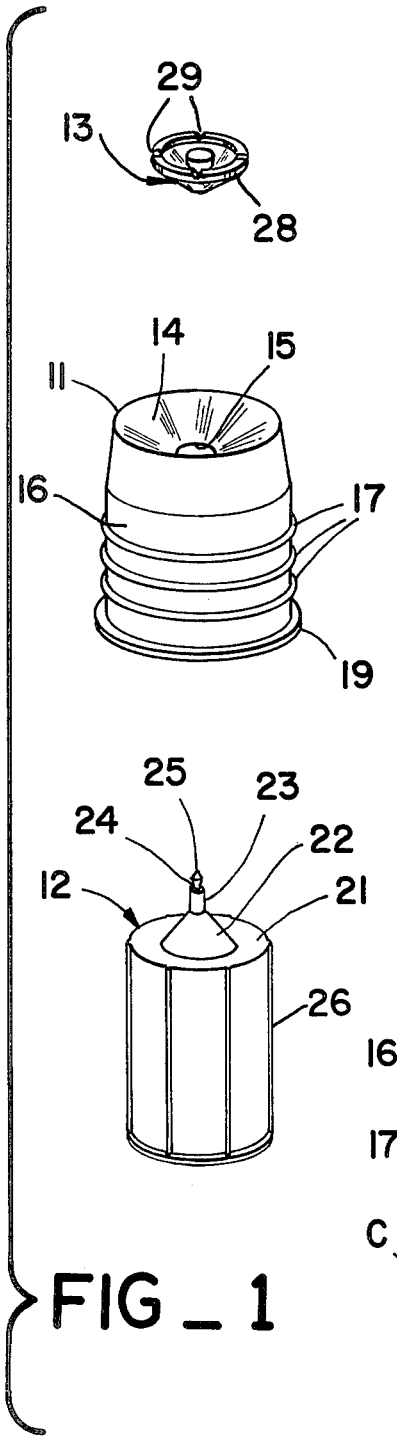
FIG. 1 is an exploded perspective of the dispenser unit, showing its three principal parts.

In FIG. 1, the three principal elements of the liquid dispenser unit 10 are shown in exploded detail. These elements consist of a cylindrical bell 11, a cylindrical buoyancy cylinder 12 and a cap seal 13.

Figure 2:
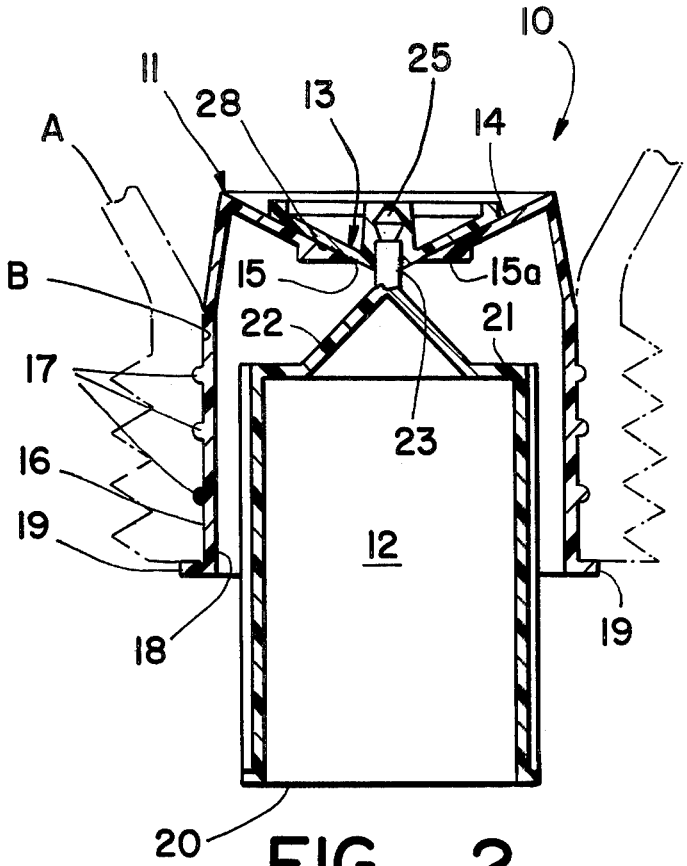
FIG. 2 is a section through the dispenser with broken lines illustrating the neck of a bottle in which the unit is installed, and also illustrating the cap seal resting on the inwardly directed conical surface of the bell in a sealing relationship.
Figure 3:
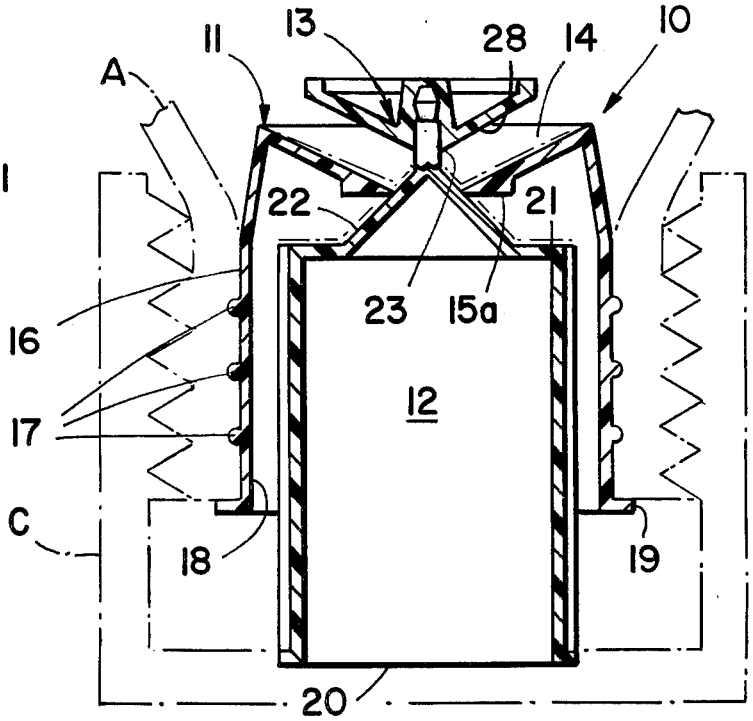
FIG. 3 is a section similar to the section of FIG. 2, but illustrating the conical crown of the buoyancy cylinder sealingly engaging the rim of the central aperture and also showing a cap in phantom which, when screwing onto the bottle neck, drives the conical crown into the aperture causing deflection of the inwardly conical surface.

The cylindrical bell 11 is closed at one end by an inwardly directed conical surface 14 having a central aperature 15 disposed therein. On the main outer wall 16 of the bell, a plurality of raised circular sealing rings 17 may be incorporated to ensure a tight sealing relationship with the inner cylindrical surface B of the neck of bottle A when the unit is installed, as shown in FIGS. 2 and 3. These sealing rings are optional. At the open end or mouth 18 of the bell is an outwardly directed radial flange 19 which, when the unit is installed as illustrated, engages the top C of the neck of the bottle A (bottle parts are shown in phantom).

As the cylindrical bell 11 is hollow, it can receive the buoyancy cylinder 12, the outer diameter of which is less than the inner diameter of the bell. Because entrapped air in the buoyancy cylinder cannot escape during operation of the unit in a water closet, it is unnecessary to close its bottom opening 20. Bottom opening is used in reference to the orientation of the unit when it is installed in a water closet with the neck of the bottle A pointing down. An end surface 21 closes the top of the buoyancy cylinder which includes a protruding conical crown 22, which includes a projecting short shaft 23 from its apex.

When the buoyancy cylinder 12 is installed within the bell 11, as shown in FIGS. 2 and 3, the projecting shaft passes through the central aperture 15 of the bell 11. A knob 24 on the distal end 25 of the shaft 23 provides a convenient method of attaching the cap seal 13, which has a central bore for receiving the distal end of the shaft with a cooperating surface for holding the cap on the end of the shaft projecting through the aperture. Of course, other methods of attaching the cap can be employed without departing from the invention.

Surrounding the aperture 15 is a reinforced aperture platen **15*a* which is integrally formed with the inwardly directed conical surface 14 at the top of the bell 11. It provides a reinforced area so the aperture will not tear (rupture) when the conical crown 22** is forced into the aperture by a cap screwed onto the neck of a bottle having the unit installed. Basically, the inwardly directed conical surface is designed to deflect when the buoyancy cylinder (whose axial length is greater than the axial length of the ball) is engaged by a cap C (shown in phantom in FIG. 3). A deflection of the phaten from 1/32 of an inch to 3/16 of an inch is acceptable to obtain a positive seal so no liquid in bottle A will be lost during shipment, even when the bottle is partially collapsed to develop a limited hydraulic pressure on the seal through its liquid contents of 1 to 5 p.s.i.

Due to the conical shape of the crown 22, the axial orientation between the ball 11 and the buoyancy cylinder 12 is not critical for a proper sealing relationship between it and the peripheral rim of aperture 15 when engagement occurs. This rim may have a rounded edge configuration if desired. However, exterior axial ribs 26 on the outer surface of the body of the buoyancy cylinder provide limited axial alignment, the conical crown will effect a sealing engagement with the aperture within such limits of the axial alignment allowed by the ribs due to the force of engagement provided by the buoyancy of the buoyancy cylinder. It should be obvious that the dispenser unit 10 is designed to be positioned in a water closet with the unit several inches below the maximum water level of the reservoir of the water closet for proper operation when this level drops during the flushing operation.

A second seal for the unit 10 is supplied through the engagement of cap seal 13 with the top of the inwardly directed conical surface 14 of the bell 11. As can be seen, a second conical sealing surface 28 is formed with the cap seal, which is inverted relative to conical surface 22 of the buoyancy cylinder as shown in the drawings. By matching the angle of this surface with the surface of the inwardly conical surface 14, a seal can be achieved when the buoyancy cylinder 12 drops to the position shown in FIG. 2, as when the reservoir of a water closet empties during a flushing operation. This seal will prevent the leakage of the liquid contents from bottle A into the reservoir while it is filling with water at a level below the buoyance cylinder level. Alternatively, the conical sealing surface, the cap can be changed so its surface forms a line seal with aperture 15. Obviously the weight of the buoyancy cylinder 12 provides the engagement force for the seal.

In operation, with unit 10 installed in the neck of a bottle A containing liquid to be dispensed and the bottle installed with the neck down and so the unit is two to three inches below the level of the water in the reservoir, the buoyancy cylinder will be in the position shown in FIG. 3. As the crown 22 effects a seal with the rim of the aperture 15 in this position, no leakage of the liquid contents in the bottle will occur. When the water closet is flushed, the reservoir empties rapidly, effectively dropping the buoyancy cylinder to the position shown in FIG. 2. Only a very small volume of liquid will be dispensed as this occurs, since the travel of the buoyancy cylinder from the position of FIG. 3 to that of FIG. 2 is of the order of $\frac{1}{8}$ of an inch or less. Small notches 29 are formed in the top rim of the cap 13 that extend into its conical surface 28. These notches aid in creating turbulent flow between the cap's surface and the cooperating conical surface of the bell so that the seal will be effected rapidly.

As the water level rises in the water closet, it will engage the buoyancy cylinder which is held down by its own weight and the weight of a cylindrical column of liquid having a cross-sectional area equal to the area of cap seal 13 circumscribed by its seal with surface 14 times the height of the column in the bottle multiplied by its density. As a result, the forces will continue to increase until the bouyancy of the cylinder exceeds combined forces opposing the upward movement of the cylinder, at which time the cylinder will ascend. Once the buoyancy cylinder commences its ascent the weight of the liquid in the bottle holding it down is equalized and passes under surface 28 the cylinder rises quickly releasing a desired quantity of liquid in the dispenser. This differential in opposing forces overcomes, in part, the different filling rates between different water closet installations, providing a more uniform time constant for transit of the cylinder between its two extreme positions of travel, thereby giving more uniform metering action of the fluid in the bottle. Of course, as the bottle empties, the time constant changes, as less force is required to overcome the lesser weight of the imaginary liquid column within the bottle resisting the upward movement of the cylinder.

When the reservoir of the water closet empties, the bell 11 fills with air which is trapped as the level of the water thereafter rises above the rim 19 of the bell. Part of this entrapped air is vented into the bottle when the cylinder 12 rises to prevent a change in metering rates from developing due to the formation of a vacuum inside the bottle as the liquid therein is dispensed.

We claim:

1. A liquid dispenser unit for bottles containing liquids that has a positive seal for shipping comprising:

a cylindrical hollow bell means having an inwardly-directed conical surface closing one end with a central aperture therein and having an outwardly-directed radial flange around its mouth so it can be inserted into the cylindrical opening in the neck of a bottle in a manner allowing its radial flange to engage the distal end surface of the cylindrical opening, said bell means having raised encircling beads about its outer periphery operable to sealingly engage the neck of the bottle in which said bell means is inserted, and said inwardly-directed conical surface having a tapered wall allowing it to be deflected for improving sealing action about such central aperture;

a buoyancy cylinder means of a smaller diameter than said bell means having a conical crown means at one end terminating in a projecting shaft, said buoyancy cylinder assembled in said bell means so its shaft can reciprocate axially in said aperture of said bell allowing its conical surface to sealingly engage said aperture when said cylinder moves into said bell means, said buoyancy cylinder having an axial length greater than that of said bell means; and a sealing cap means having a diameter greater than said aperture fixedly connected to the distal end of said shaft projecting through said aperture and also having a surface operable to engage the outer surface of said inwardly-directed surface of said cylinder whereby said cylinder due to its buoyancy will cause said conical surface to sealingly engage said aperture and loss of buoyancy thereon will cause said cap means to sealingly close off flow when the unit is in an environment of rising and falling water levels and liquid will be dispersed during the transit times between the two resulting sealing positions, said sealing cap having notches in its rim to effect turbulent flow therearound when it closes to improve its sealing action when it engages such central aperture in said hollow bell means.

2. In combination with a bottle having a neck with a circular opening therein and a bottle cap attachable thereto, a liquid dispensing unit operated by changing water levels when installed in the circular opening and the bottle is inverted comprising:

a cylindrical hollow bell means having an inwardly-directed conical surface closing one end with a central aperture and a radial projecting flange surrounding its mouth, said bell means inserted in said opening in sealing engagement so its radial flange contacts the distal end of said neck of said bottle, said hollow bell means having raised encircling beads about its outer periphery operable to engage said neck of said bottle in sealing relationship, and said inwardly-directed conical surface having a tapered wall allowing it to be deflected at such aperture for sealing operations;

a buoyancy cylinder means of a smaller diameter than said bell means having a conical crown means at one end terminating in a projecting shaft, said buoyancy cylinder reciprocally received in said bell means so said shaft projects through said aperture in said bell means, said buoyancy cylinder having an axial length greater than that of said hollow bell means;

a sealing cap means fixed to the end of said shaft, said cap means being larger than said aperture and operable to limit the reciprocation of said buoyancy cylinder in said bell, whereby said conical crown effects a seal when said cylinder moves into said bell and said cap means effects a seal when said cylinder moves out of said bell, said sealing cap having notches on its rim to effect turbulent flow therearound to improve its sealing action when it sealingly engages such central aperture of said hollow bell means, and said bottle cap engaging the projecting portion of said buoyancy cylinder when axially assembled on the neck of said bottle and operable to force said conical crown of said buoyancy cylinder into said aperture deflecting said conical surface for a positive seal for shipping.

* * * * *